United States Patent [19]

Watanabe

[11] Patent Number: 5,070,757

[45] Date of Patent: Dec. 10, 1991

[54] ELECTRONIC TONE GENERATOR

[75] Inventor: Noboru Watanabe, Tokyo, Japan

[73] Assignee: SC HighTech Center Corp., Tokyo, Japan

[21] Appl. No.: 441,564

[22] Filed: Nov. 27, 1989

[30] Foreign Application Priority Data

Mar. 29, 1989 [JP] Japan ..... 1-35948[U]

[51] Int. Cl.[5] ..... G10H 5/04; G10H 5/02

[52] U.S. Cl. ..... 84/622; 84/625; 84/660

[58] Field of Search ..... 84/610, 617, 625, 629, 84/627, 622, 659–661, 670

[56] References Cited

U.S. PATENT DOCUMENTS

| | | | |
|---|---|---|---|
| 4,186,642 | 2/1980 | Gross | 84/678 |
| 4,273,019 | 6/1981 | Goto | 84/662 |
| 4,554,855 | 11/1985 | Alonso et al. | 84/625 |
| 4,630,518 | 12/1986 | Usami | 84/610 |
| 4,641,563 | 2/1987 | Nagashima | 84/DIG. 11 |
| 4,651,612 | 3/1987 | Matsumoto | 84/650 |
| 4,934,239 | 6/1990 | Tsai | 84/628 |

FOREIGN PATENT DOCUMENTS

| | | |
|---|---|---|
| 62-35117 | 7/1987 | Japan . |
| 63-19880 | 4/1988 | Japan . |

*Primary Examiner*—William M. Shoop, Jr.

*Assistant Examiner*—Brian Sircus

*Attorney, Agent, or Firm*—Ostrager & Chong

[57] ABSTRACT

An electronic tone generator in which a plurality of types of scale data and tone-length data are stored in an associative arrangement at predetermined addresses in a single storage device. The plurality of types of scale data read from the single storage device are input to corresponding waveform generators, where melody-waveform signals are generated. The melody-waveform signals generated in the respective waveform generators are mixed and synthesized by a mixer before being output from an output device. The waveform generators are adapted to switch envelope waveforms generated by envelope-waveform generators of a digital circuit configuration with waveform signals corresponding to the scale data, thereby obtaining melody-waveform signals. One of the waveform generators is adapted to generate a melody-waveform signal having a frequency which is an integral multiplication of the frequency of a main melody, for example, three times the frequency thereof, or to generate a melody-waveform signal giving a tremolo effect. To this electronic tone generator can be added a waveform generator for generating a percussion-waveform signal; the melody-waveform signals can be mixed and synthesized with the percussion-waveform signal, which makes it possible to output a melody with an accompaniment.

8 Claims, 9 Drawing Sheets

70
11
SCALE-PULSE GENERATING SECTION
2
BASIC-PULSE GENERATING SECTION
1
LP
BP
PROGRAMMABLE COUNTER
6
PROGRAMMABLE COUNTER
6'
PROGRAMMABLE COUNTER
3
STORAGE CIRCUIT
5
ADDRESS COUNTER
4
MT
ST
SLD
MLD
ADDR
LGT
WAVEFORM GENERATING SECTION
7
WAVEFORM GENERATING SECTION
7'
WAVEFORM GENERATING SECTION
12
CMW
CSW
PW
MIXING SECTION
8
AMPLIFYING SECTION
9
OUTPUT SECTION
10

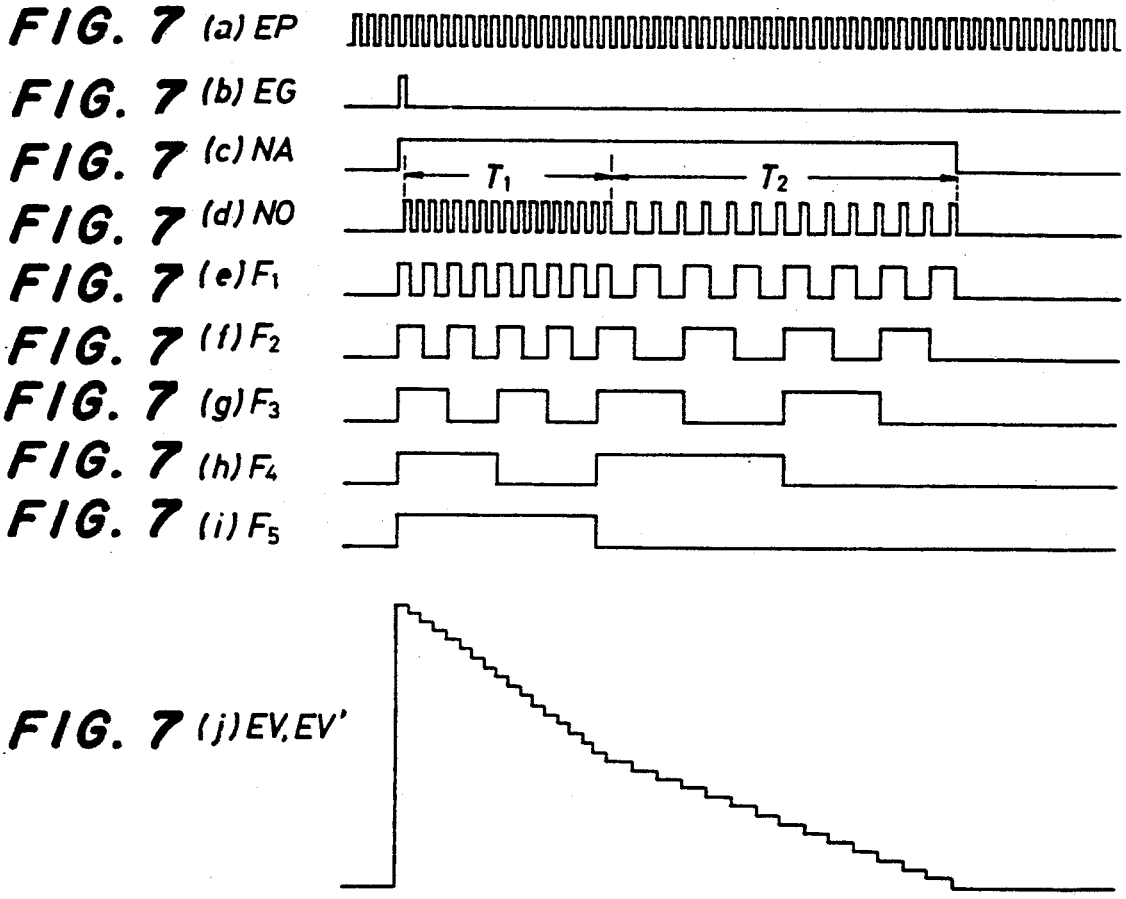
FIG. 7 (a) EP
FIG. 7 (b) EG
FIG. 7 (c) NA
$T_1$
$T_2$
FIG. 7 (d) NO
FIG. 7 (e) $F_1$
FIG. 7 (f) $F_2$
FIG. 7 (g) $F_3$
FIG. 7 (h) $F_4$
FIG. 7 (i) $F_5$
FIG. 7 (j) EV, EV'

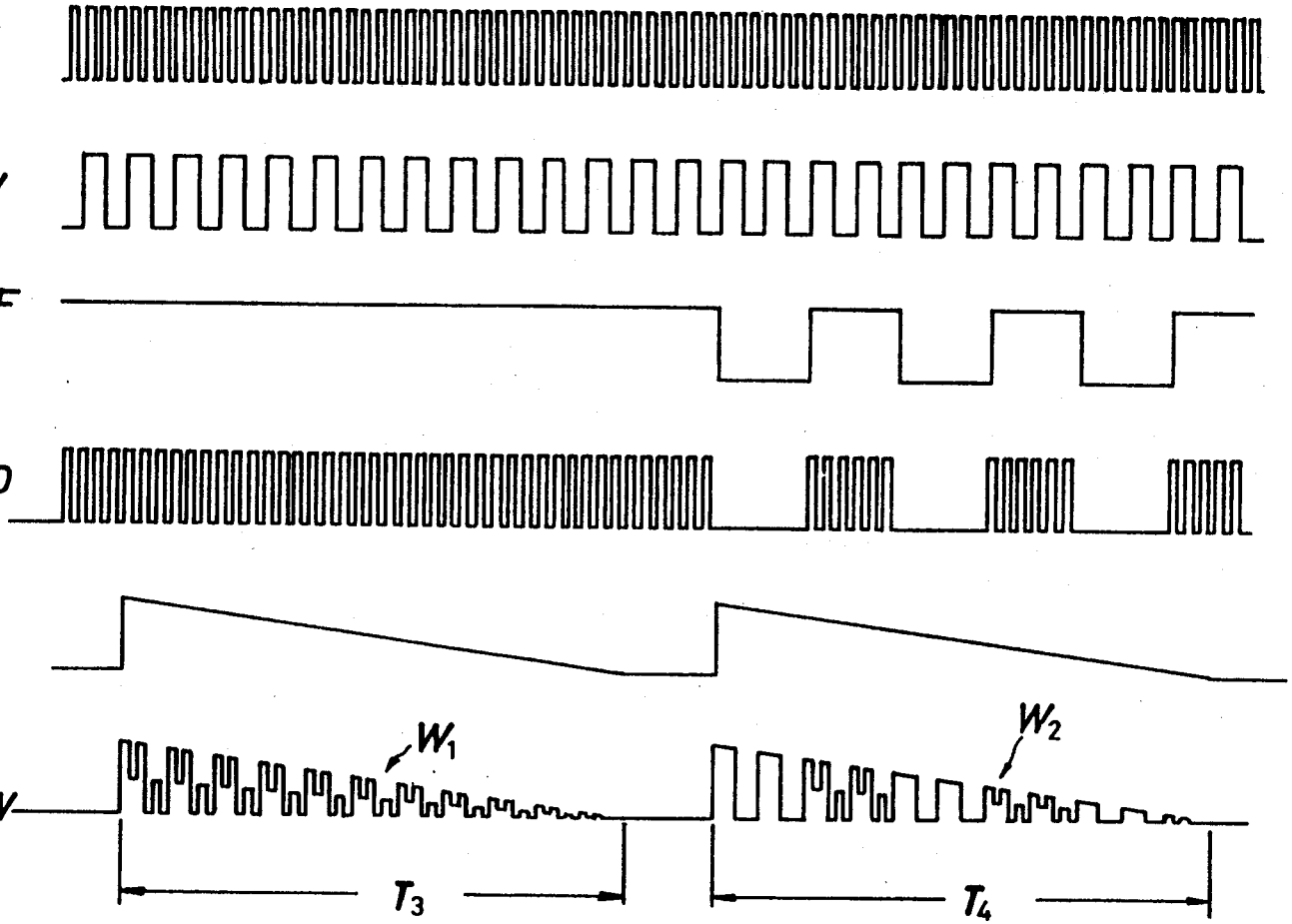
FIG.8 (a) TW
FIG.8 (b) MW
FIG.8 (c) SWF
FIG.8 (d) AND
FIG.8 (e) EV
FIG.8 (f) CMW FIG.9 (a) NS
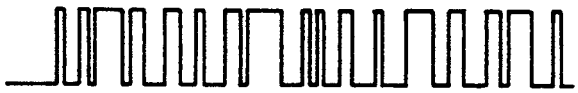
FIG.9 (b) EV*
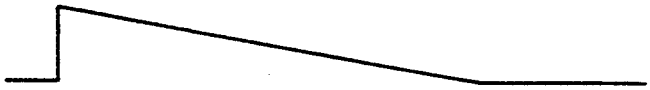
FIG.9 (c) PW
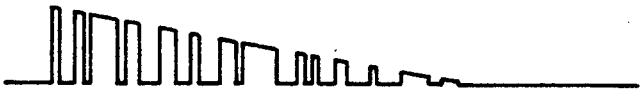

ELECTRONIC TONE GENERATOR

BACKGROUND OF THE INVENTION

This invention relates to an electronic tone generator for producing melodies.

Examples of conventional electronic tone generators are disclosed, for example, in Japanese Patent Publications No. 62-35117 and 63-19880 as well as U.S. Pat. No. 4,273,019.

FIG. 10 is a block diagram of a conventional electronic tone generator of this type. The generator shown comprises a basic-pulse generating section 101 for generating basic pulses having a period representative of the shortest duration of a musical note used in constructing the melody, a scale-pulse generating section 102 for generating scale-generating pulses, scale generating sections 111 and 111' for generating a plurality of (for example, two) types of scale data, a plurality of (for example, two) waveform generating sections 107 and 107' for generating melody-waveform signals corresponding to the respective types of scale data generated in the respective scale generating sections 111 and 111', on the basis of these types of scale data, a mixing section 108 for mixing the melody-waveform signals generated in the waveform generating sections 107 and 107' with each other, an amplifying section 109 for amplifying the mixed signals, and an output section 110 for outputting the amplified signals after converting them into an acoustic signal.

The scale generating section 111 is adapted, for example, to generate the scale of a main melody, and comprises a storage circuit 105 for storing the scale data and tone-length data on the main melody, an address counter 104 for specifying addresses in the storage circuit 105, a programmable counter 103 adapted to receive tone-length data output from the storage circuit 105 and to generate tone-lengths by dividing basic pulses generated by the basic-pulse generating section 101, and a programmable counter 106 adapted to receive scale data output from the storage circuit 105 and to generate scales by dividing scale-generating pulses generated by the scale-pulse generating section 102.

The scale generating section 111' is adapted, for example, to generate the scale of a sub-melody, and comprises a storage circuit 105' for storing the scale data and tone-length data on the sub-melody, as well as an address counter 104' and programmable counters 103', 106', which have functions similar to those of the address counter 104 and programmable counters 103, 106, respectively.

In an electronic tone generator having the above-described construction, the scale signals for the main melody and sub-melody are generated on the basis of the scale data and the tone-length data stored in the storage circuits 105 and 105'.

The scale signals thus generated are input to the waveform generating sections 107 and 107', where they are waveform-processed into a main-melody-waveform signal and a sub-melody-waveform signal and are output to the mixing section 108 The mixing section 108 mixes the main-melody-waveform signal with the sub-melody-waveform signal, and the mixed signals can be output in the form of an acoustic signal through the amplifier 109 and the output section 110.

Furthermore, in the conventional electronic tone generator described above, an envelope waveform is imparted to melody-waveform signals with a view to generating an electronic tone spreading widely, which provides high acoustic and musical effects.

However, the conventional electronic tone generator is equipped with separate scale generating sections 111 and 111' so that it may simultaneously generate tones of different (for example, two) scales, and, in particular, it requires a plurality of storage circuits 105, 105', address counters 104, 104', and programmable counters 103, 103', the address counters 104, 104' requiring synchronization As a result, the size and construction of the circuit becomes larger and more complicated as the number of kinds of scales to be simultaneously generated increases, which means there is a limitation to the reduction in the size and price of the generator. Furthermore, when realizing this electronic tone generator in a single integrated circuit, it is rather difficult to arrange the entire generator in a more compact form in the integrated circuit since the circuit for imparting an envelope waveform is formed as an analog circuit arranged externally with respect to the integrated circuit.

In addition, the conventional electronic tone generator can merely output a rather monotonous tone which consists of a mixture of a main melody and a sub-melody only, and is not capable of outputting a tone providing a remarkably high musical effect.

SUMMARY OF THE INVENTION

It is accordingly the object of this invention to provide an electronic tone generator whose circuit size and construction are relatively small and simple and which can be arranged in a compact form in an integrated circuit, yet which is capable of outputting a tone giving a remarkably high musical effect.

In accordance with this invention, there is provided an electronic tone generator comprising: a single storage means in which a plurality of types of scale data and tone-length data are stored at predetermined addresses in an associative arrangement; a plurality of waveform generating means provided in correspondence with the respective types of scale data read from the storage means and adapted to generate melody-waveform signals corresponding to the respective types of scale data; mixing means for mixing the melody-waveform signals from the respective waveform generating means with each other and for synthesizing them; and output means for outputting the synthesized signals.

The generator may further comprise percussion-waveform generating means for generating a percussion-waveform signal. In that case, the mixing means mixes the melody-waveform signals with the percussion-waveform signal and synthesizes them.

BRIEF DESCRIPTION OF THE DRAWINGS

FIGS. 6(*c*) and 6(*d*) are diagrams showing examples of the output waveforms of the main melody and the sub-melody, respectively;

FIGS. 7(*a*) to 7(*f*) are time charts for illustrating the operation of the envelope-data generating circuits of FIGS. 2 and 3;

FIGS. 8(*a*) to 8(*f*) are time charts for illustrating the operation performed in the waveform generating sections of FIG. 2;

FIGS. 9(*a*) to 9(*c*) are time charts for illustrating the operation performed in the waveform generating sections of FIG. 4.

DETAILED DESCRIPTION OF THE PREFERRED EMBODIMENTS

Figure 1:
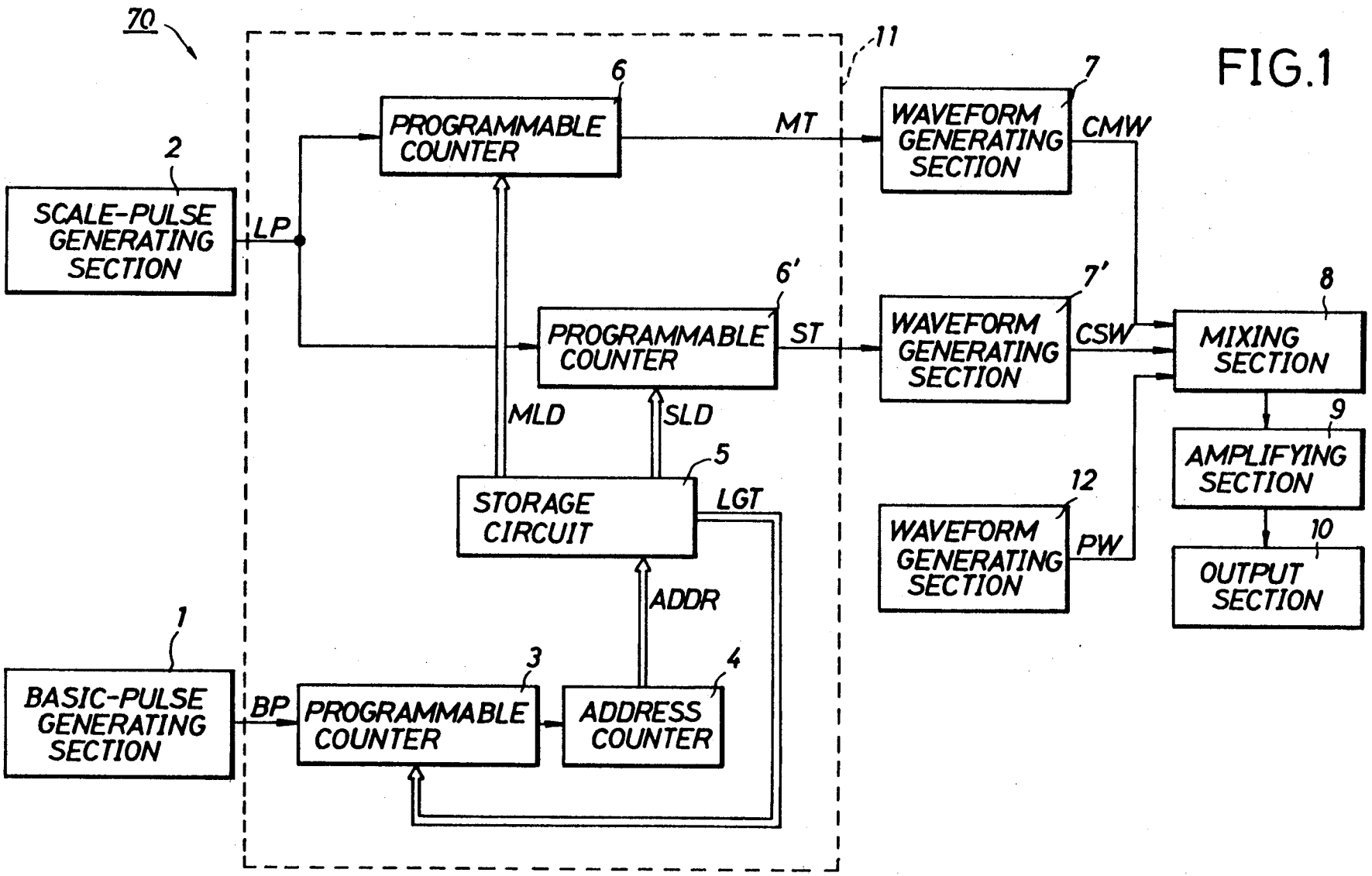
FIG. 1 is a block diagram of an electronic tone generator in accordance with an embodiment of this invention.

Referring to FIG. 1, an electronic tone generator 70 comprises: a basic-pulse generating section 1 for generating basic pulses BP having a period representative of the shortest duration of a musical note; a scale-pulse generating section 2 for generating scale-generating pulses LP; a scale generating section 11 for generating a plurality of types of scale signals; a plurality of waveform generating sections 7, 7' for generating, on the basis of the plurality of scale signals generated by the scale generating section 11, melody-waveform signals respectively corresponding to these scale signals; a waveform generating section 12 for generating percussion waveforms; a mixing section 8 for mixing the different waveform signals generated by the waveform generating sections 7, 7' and 12 with each other; an amplifying section 9 for amplifying the mixed waveform signals; and an output section 10, such as a speaker, for outputting the amplified waveform signals.

The scale generating section 11 is adapted, for example, to simultaneously output the scales of a plurality of melodies, i.e., of a main melody and a sub-melody. The scale generating section 11 comprises: a single storage circuit 5 for storing main-melody scale data MLD, sub-melody scale data SLD, and tone-length data LGT; an address counter 4 for specifying addresses ADDR in the storage circuit 5; a programmable counter 3 adapted to receive tone-length data LGT output from the storage circuit 5 and to generate tone lengths by dividing basic pulses BP generated by the basic-pulse generating section 1; and programmable counters 6, 6' adapted to receive main-melody scale data MLD and sub-melody scale data SLD output from the storage circuit 5 and to output a main-melody scale signal MT and a sub-melody scale signal ST, respectively, by dividing scale-generating pulses generated by the scale-pulse generating section 2.

The waveform generating section 7 is adapted to generate a main-melody waveform signal CMW on the basis of the main-melody scale signal MT from the programmable counter 6.

Figure 2:
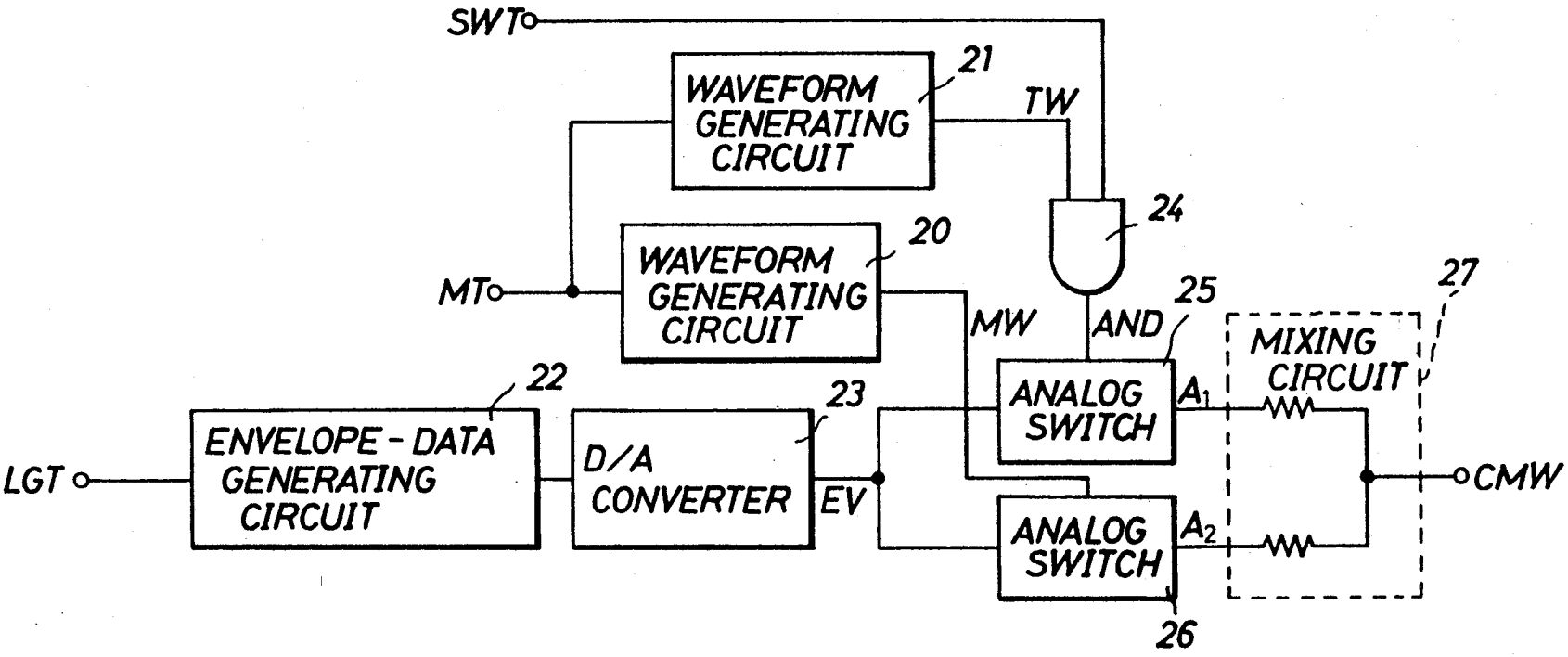
FIGS. 2, 3 and 4 are block diagrams showing examples of the waveform-generating sections of FIG. 1.

FIG. 2 is a block diagram showing a configuration example of the waveform generating section 7. The waveform generating section 7 comprises: a waveform generating circuit 20 adapted to receive the main-melody scale signal MT and to generate a waveform signal MW having the frequency of the main melody; a waveform generating circuit 21 adapted to receive the main-melody scale signal MT and to generate a waveform signal TW having three times the frequency of the main melody; an envelope-data generating circuit 22 adapted to read tone-length data from the storage circuit 5 and to generate the envelope data for the main melody; a D/A converter 23 for digital/analog-converting of the envelope data into an envelope-waveform signal EV; an AND circuit 24 for carrying out the logical AND between the waveform signal TW from the waveform generating circuit 21 and a switching signal SWT for generating tremolos; an analog switch 25 for switching the envelope-waveform signal EV with an output signal AND of the AND circuit 24; an analog switch 26 for switching the envelope-waveform signal EV with the waveform signal MW from the waveform generating circuit 20; and a mixing circuit 27 for mixing output signals $A_1$ and $A_2$ from the analog switches 25 and 26 with each other to synthesize them into a main-melody waveform signal CMW.

The waveform generating section 7' is adapted to generate a sub-melody waveform signal CSW on the basis of the sub-melody scale signal ST from the programmable counter 6'.

Figure 3:
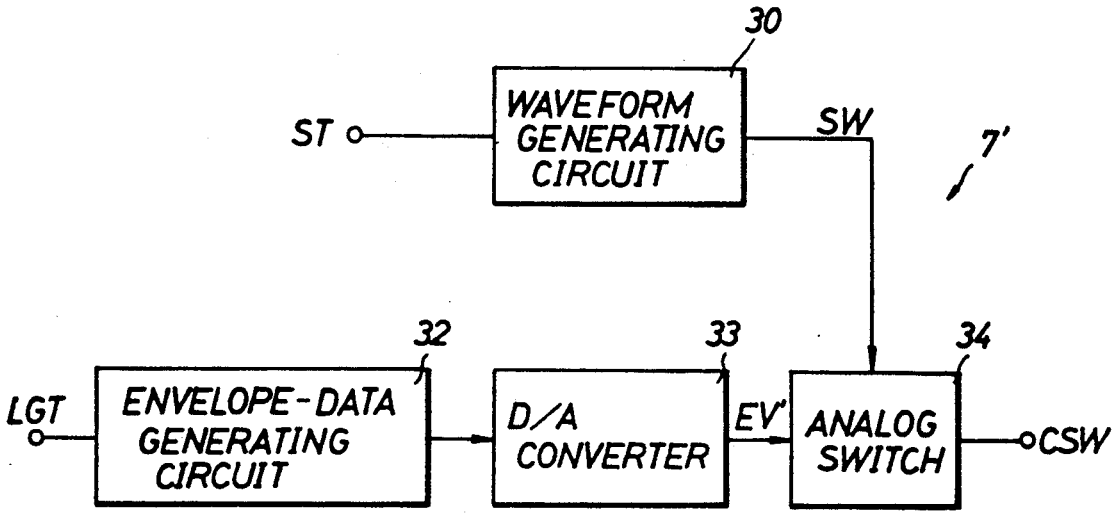

FIG. 3 is a block diagram showing an configuration example of the waveform generating section 7'. The waveform generating section 7' shown comprises: a waveform generating circuit 30 adapted to receive the sub-melody scale signal ST and to generate a waveform signal SW having the frequency of the sub-melody; an envelope-data generating circuit 32 adapted to receive tone-length data LGT from the storage circuit 5 and to generate envelope data for the sub-melody; a D/A converter 33 for digital/analog-converting the envelope data into an envelope-waveform signal EV'; and an analog switch 34 adapted to switch the envelope-waveform signal EV' with the waveform signal SW from the waveform generating circuit 30 and to output the same in the form of a sub-melody waveform signal CSW. The tone-length data LGT is common to the main melody and the sub-melody, so that, in this embodiment, the tone length of the main melody is the same as that of the sub-melody.

Figure 4:
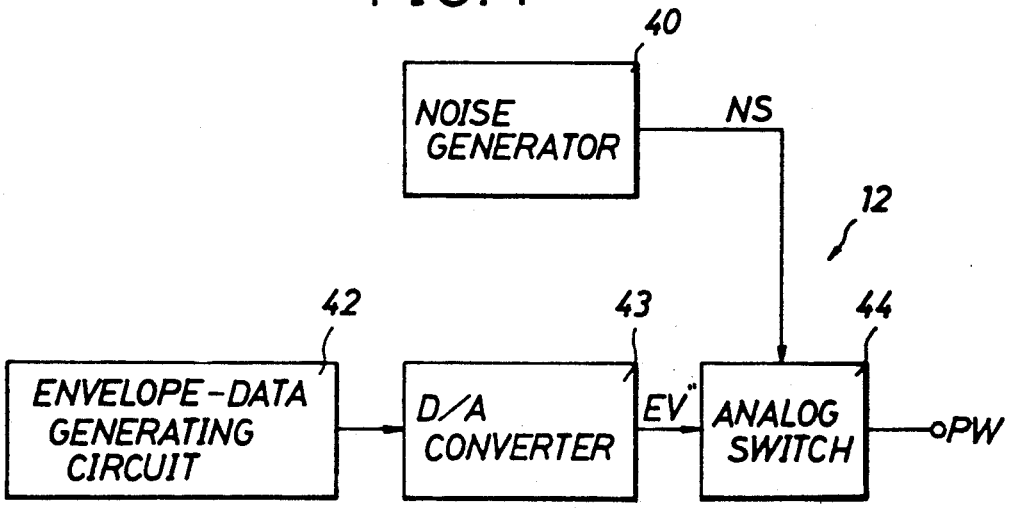

FIG. 4 is a block diagram showing a configuration example of the waveform generating section 12 for generating a percussion-waveform signal PW. The waveform generating section 12 shown comprises: a noise generator 40 for generating percussion sounds; an envelope-data generating circuit 42 for generating percussion envelope data; a D/A converter 43 for digital-/analog-converting percussion envelope data into a percussion-envelope-waveform signal EV"; and an analog switch 44 for switching the envelope-waveform signal EV" with a noise signal NS from the noise generator 40 and to output the same in the form of a percussion-waveform signal PW.

Figure 5:
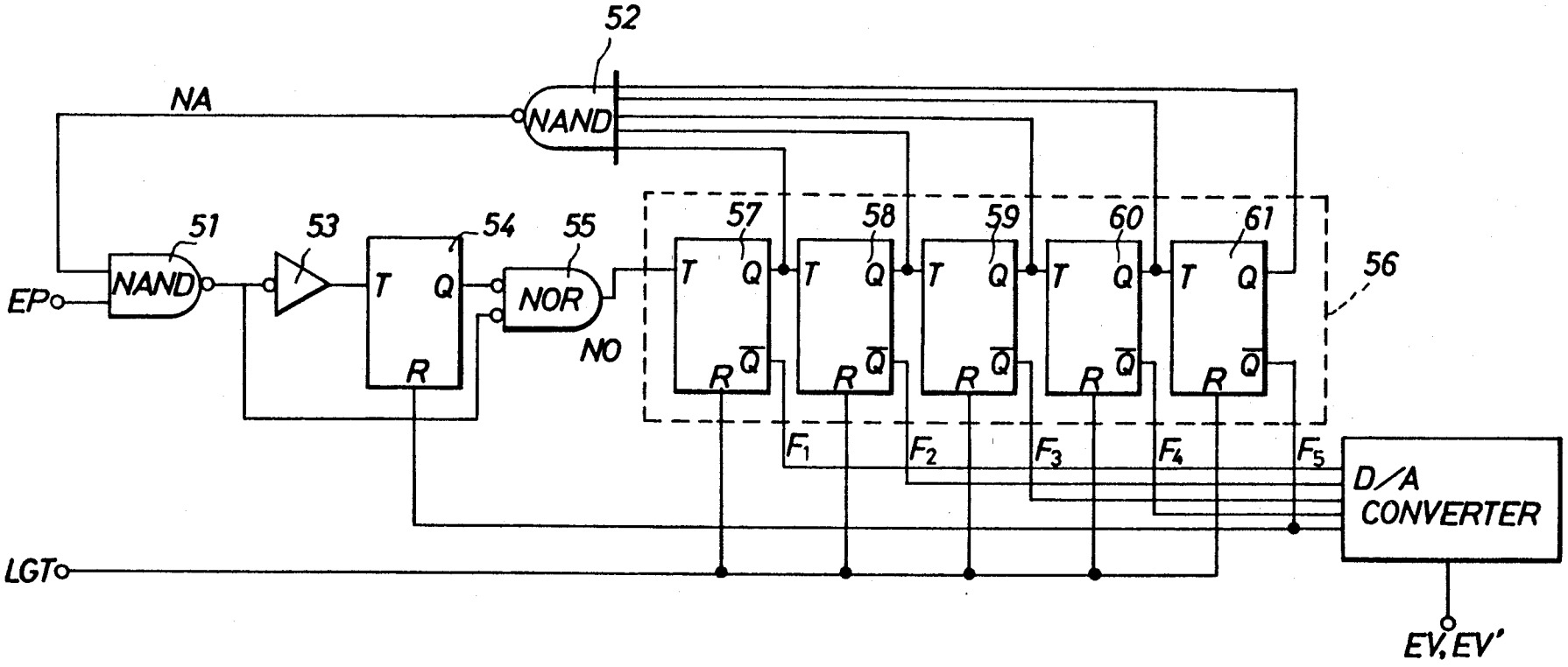
FIG. 5 is a circuit diagram showing an example of the envelope-data generating circuit and of the D/A converter of FIG. 1.
Figure 6A:
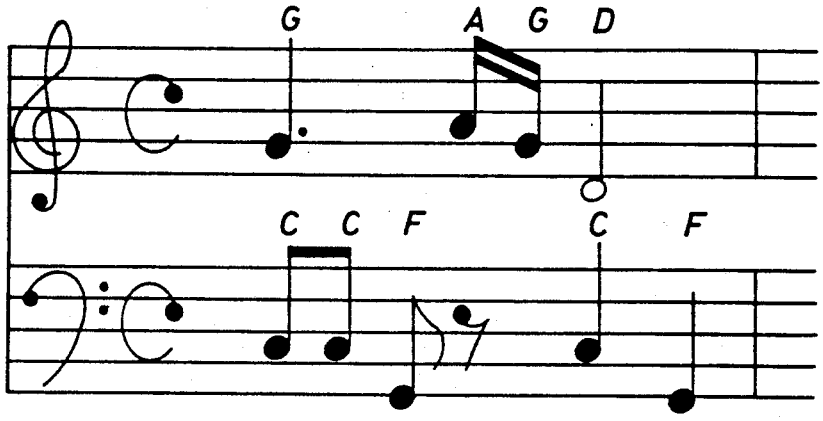
FIGS. 6(*a*) and 6(*b*) show examples of musical scores to be stored in the storage circuit of FIG. 1.
Figure 6B:
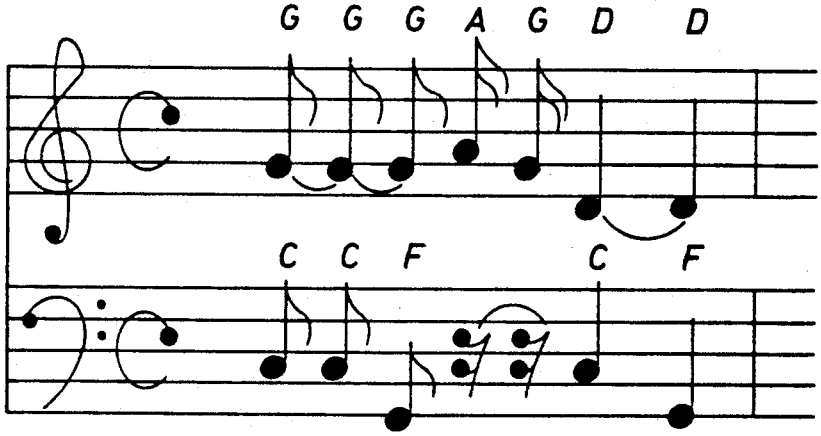
Figure 6C:
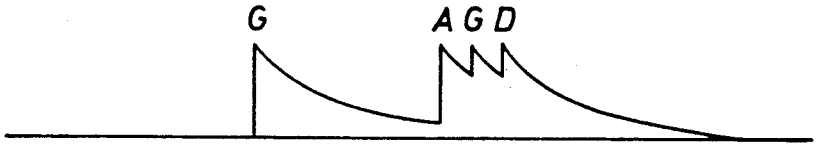
Figure 6D:
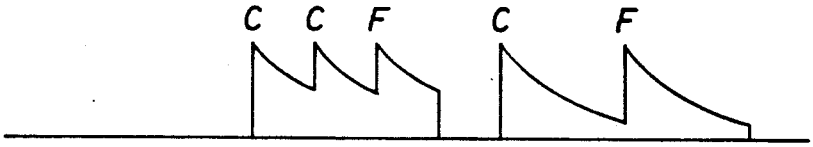
Figure 10:
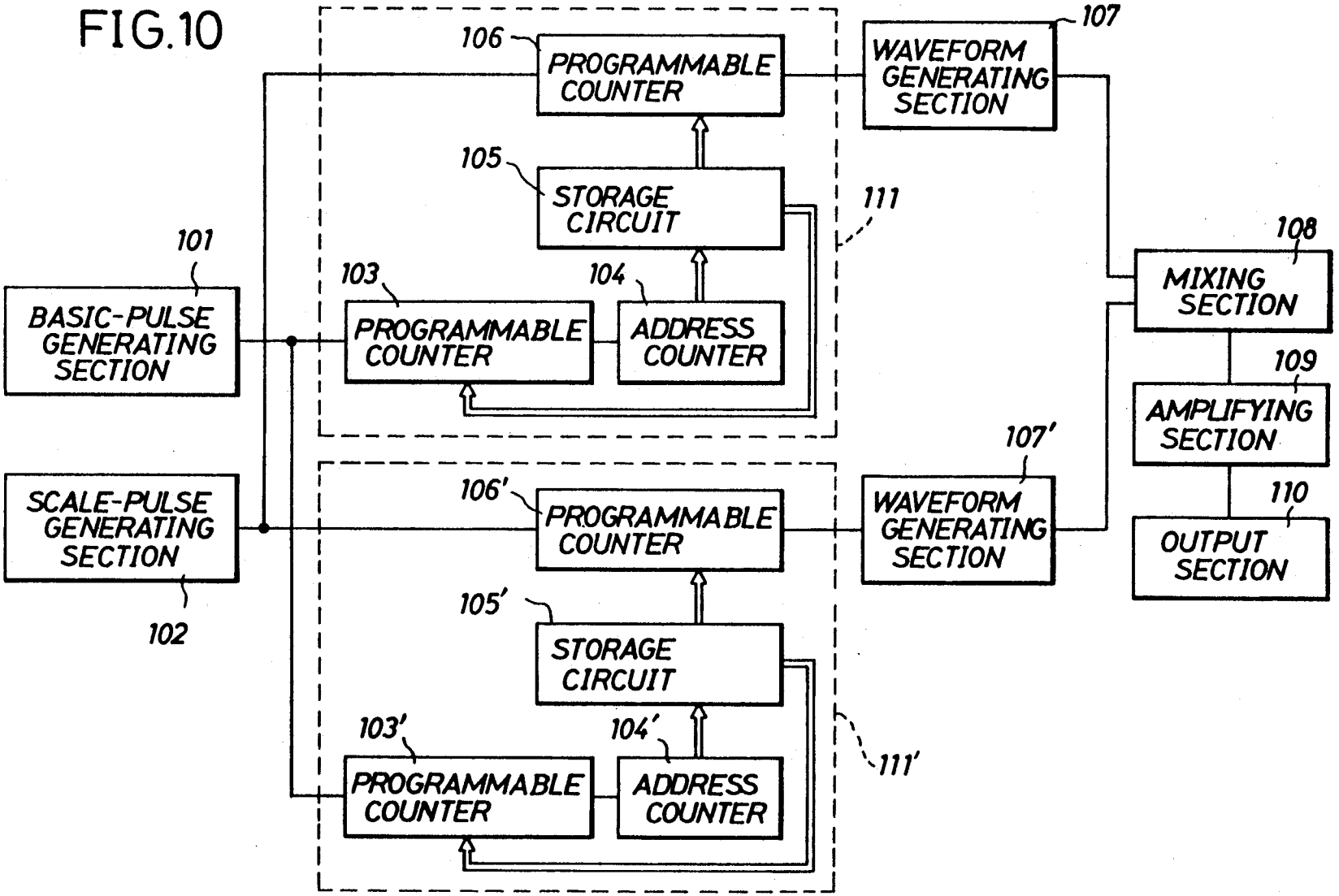
FIG. 10 is a block diagram of a conventional electronic tone generator.

The envelope-data generating circuits 22, 32 and 42 as well as the D/A converters 23, 33 and 43 provided in the waveform generating sections 7, 7' and 12 shown in FIGS. 2 to 4 have, for example, the construction shown in FIG. 5. In the example shown in FIG. 5, the envelope-data generating circuits 22, 32 and 42 use envelope generating pulses EP as the clock for generating envelope signals and are operated by using edge signals EG of tone-length data LGT as the start pulses for generating envelope signals. Each of these envelope-data generating circuits is composed of NAND circuits 51 and 52, an inverter circuit 53, a T-type flip-flop 54, a NOR circuit 55, and a dividing circuit 56 which consists of T-type flip-flops 57, 58, 59, 60 and 61.

The mixing section 8 is of a resistance-AND type utilizing resistance.

The operation of the electronic tone generator 70 having the above-described construction will now be described.

Before actually operating the electronic tone generator 70, it is necessary to store musical score, for example, the one shown in FIG. 6(*a*), in the storage circuit 5. In this process, the lengths of the notes in the main melody and the sub-melody of FIG. 6(*a*) are arranged as shown in FIG. 6(b), the longer notes being tied together so that the main melody has the same rhythm as the sub-melody. That is, the tone lengths of the main melody are made identical to those of the sub-melody. As a result, the scale data on the main melody, the scale data on the sub-melody, and the tone-length data on the main melody and the sub-melody are stored at an address in the storage circuit 5. FIGS. 6(*c*) and 6(*d*) exclusively show envelope waveforms; the waveforms shown do not contain the frequency components, so that they differ from the actual output waveforms.

After thus storing predetermined data in a single storage circuit 5, the electronic tone generator 70 is operated by causing basic pulses BP and scale-generating pulses LP to be generated by the basic-pulse generating section 1 and the scale-generating-pulse generating section 2, respectively.

It is to be assumed here that the address counter 4 is set at the initial value at the start. The storage circuit 5 is addressed by address ADDR of the address counter 4, and the data in that address position, i.e., the main-melody scale data MLD, the sub-melody scale data SLD, and the tone-length data LGT are output from the storage circuit 5. The main-melody scale data MLD and the sub-melody scale data SLD 1 are input to the programmable counters 6 and 6', respectively. The main-melody scale signal MT and the sub-melody scale signal ST are output from the programmable counters 6 and 6', respectively.

The tone-length data LGT output from the storage circuit 5 is input to the programmable counter 3, which serves to prevent the address value that is output exclusively during the period corresponding to the tone-length data LGT from being changed. Thus, the values of the scale data MLD and SLD output from the storage circuit 5 do not change during the period corresponding to the tone-length data LGT.

Further, the tone-length data LGT is input to the envelope-data generating circuits 22, 32 (not shown in FIG. 1) of the waveform generating sections 7, 7', and the envelope-data generating circuits 22, 32 are operated using the edge signal EG of this tone-length data LGT as the trigger.

FIGS. 7(*a*) to 7(*j*) are time charts illustrating the operation of the envelope-data generating circuits 22 and 32. First, the edge signal EG of the tone-length data LGT, shown in FIG. 7(*b*), is input as the start pulse. Then, the dividing circuit 56 is operated in synchronism with the envelope-generating pulses EP shown in FIG. 7(*a*). Output from the terminals $\overline{Q}$ of the T-type flip-flops 57 to 61 of the dividing circuit 56 are the signals $F_1$ to $F_5$ shown in FIGS. 7(*e*) to 7(*i*). As long as the signal level of the signal from the terminal Q of any one of the T-type flip-flops 57 to 61 remains low, the signal level of the output signal NA of the NAND circuit 52 is high, as shown in FIG. 7(*c*), and an NO signal as shown in FIG. 7(*d*) is output from the NOR circuit 55, thus causing the signals $F_1$ to $F_5$ to be output in the manner shown in FIGS. 7(*e*) to 7(*i*). The operation of the T-type flip-flop 54 is started when the T-type flip-flop 61 of the dividing circuit 56 is inverted, and the period of the signal NO from the NOR circuit 55 is doubled. This causes the periods of the signals $F_1$ to $F_5$ from the T-type flip-flops 57 to 61 to be twice longer during the period $T_2$ than during the period $T_1$, and the envelope-waveform signals EV and EV' obtained by digital/analog-converting the signals $F_1$ to $F_5$ by means of the D/A converters 23 and 33 exhibit a gentle waveform which is approximately equivalent to a CR-discharge-characteristic waveform, as shown in FIG. 7(*j*).

Thus, this embodiment allows envelope-waveform signals having a gentle waveform to be obtained by means of simple digital circuits. While in the above-described example envelope-waveform signals are obtained by D/A-converting 5-bit digital signals, digital signals having a number of bits other than 5 may also be employed.

By the above-described envelope-waveform signals EV, EV' and through the input of the main-melody scale signal MT and the sub-melody scale signal ST from the scale generating section 11, the main-melody waveform signal CMW and the sub-melody waveform signal CSW are prepared in the waveform generating sections 7 and 7'.

FIGS. 8(*a*) to 8(*f*) are time charts showing the operation performed in the waveform generating section 7. Upon receiving the main-melody scale signal MT from the scale generating section 11, the waveform signal MW having the frequency of the main melody, as shown in FIG. 8(b*)*, is generated in the waveform generating circuit 20 of the waveform generating section 7, and the waveform signal TW having three times the frequency of the main melody, as shown in FIG. 8(*a*), is generated in the waveform generating circuit 21 of the same waveform generating section.

Suppose the switching signal SWT for generating tremolos is ON during the period $T_3$, and alternately changes during the period $T_4$, as shown in FIG. 8(*c*). During the period $T_3$, the AND signal from the AND circuit 24 is, as shown in FIG. 8(*d*), identical to the waveform signal TW having three times the frequency of the main melody. When, in the analog switches 25 and 26, switching is performed on the envelope-waveform signal EV as shown in FIG. 8(*e*) with the AND signal and the waveform signal MW, respectively, and the results obtained $A_1$ and $A_2$ are mixed with each other, a triple-overtone-synthesized waveform $W_1$ in which the frequency of the main melody is synthesized with three times the main-melody frequency, as shown in FIG. 8(*f*), is obtained as the main-melody waveform signal CMW.

During the period $T_4$, in contrast, the AND signal from the AND circuit 24 becomes a signal in which, as shown in FIG. 8(*d*), the waveform signal TW having three times the frequency of the main melody as shown in FIG. 8(*a*), appears alternately; when the signals $A_1$ and $A_2$ from the analog switches 25 and 26 are mixed with each other, a main-melody waveform signal CMW as indicated by the reference character $W_2$ of FIG. 8(*f*) can be obtained.

Thus, in the waveform generating section 7 of this embodiment, a triple-overtone synthesis is effected by constantly keeping the switching signal SWT in the ON condition, thereby making it possible to generate metallic tones. Further, by alternately turning on and off the switching signal SWT, and setting this switching frequency to an appropriate tremolo frequency of about 10 Hz, a natural tremolo tone which does not sound like a disconnected series of sounds can be obtained. Thus, it has been made possible to generate a tone which gives a high musical effect, unlike the monotonous square-wave tones of conventional melody ICs.

In the waveform generating section 7', the waveform generating circuit 30 generates the waveform signal SW on the basis of the sub-melody-scale signal ST from the scale generating section 11, and the analog switch 34 performs switching on the envelope-waveform signal EV' from the D/A converter 33 with the waveform signal SW, outputting it as the sub-melody-waveform signal CSW.

In the waveform generating section 12, signals are generated in the manner shown in FIGS. 9(*a*) to 9(*c*). That is, the noise generator 40 generates the noise signal NS, as shown in FIG. 9(*a*), and, by switching, at the analog switch 44, the envelope-waveform signal EV" shown in FIG. 9(*b*) with the noise signal NS, a percussion-waveform signal PW giving a sound like that of cymbals can be output, as shown in FIG. 9(*c*). If the generation of a percussion-waveform signal PW giving, instead of a cymbals sound, a sound like that of a drum is desired, a square-wave signal having a frequency of about 200 Hz is to be generated, instead of the noise signal NS. By generating these two types of percussion sounds to the time of the melody, a percussion accompaniment can be realized with a simple circuit configuration.

The main-melody-waveform signal CMW, the sub-melody-waveform signal CSW, and the percussion-waveform signal PW, output from the waveform generating sections 7, 7', and 12, respectively, are mixed with each other and synthesized in the mixing section 8. The synthesized sound is amplified by the amplifier 9 and is output from the output section 10 as an acoustic signal.

By mixing, in the mixing section 8, the main-melody waveform signal CMW with the sub-melody waveform signal CSW, a chord giving a high musical effect can be obtained, and, by mixing this with the percussion-waveform signal PW, it is made possible to output a melody accompanied by a percussion sound, which gives a higher musical effect.

Thus, in accordance with this embodiment, a plurality of types of scale data are read from a single storage means, so that, unlike in the prior art, it is not necessary to provide separate storage circuits in correspondence with scale data on a plurality of melodies, which allows the size and construction of the circuit to be diminished and simplified. Furthermore, by providing the waveform generating means with envelope-waveform generating means of a digital circuit configuration, the entire electronic tone generator can be arranged in a compact form in a single integrated circuit, without externally arranging the analog parts such as capacitors and resistors.

Further, by generating, in the waveform generating section 7, a main melody having a triple-overtone-synthesized waveform or a tremolo effect and synthesizing this with the sub-melody of the waveform generating section 7', and further, with the percussion waveform of the waveform generating section 12, a chord giving a much higher musical effect as compared with the prior art can be output in spite of the simple construction of the generator.

While in the above-described embodiment the waveform signal TW having three times the frequency of the main melody is generated in the waveform generating circuit 21 of the waveform generating section 7, the frequency of the waveform signal TW is not limited to three times the frequency of the main melody. It is also possible to generate a waveform signal TW having a frequency which is an integral multiplication of (for example, 2 times, 4 times, 5 times, etc.) the frequency of the main melody, thus outputting, instead of a triple-overtone-synthesized waveform, a double-overtone-synthesized waveform, a quadruple-overtone-synthesized waveform, and so on.

Further, the waveform generating section 7' for generating the sub-melody-waveform signal CSW may be equipped with a function of generating integral-multiple overtones through synthesis as well as a function of generating tremolo waveforms; these functions are similar to those of the waveform generating section 7.

Further, while in the above-described embodiment the scale generating section 11 is adapted to generate two types of scale data MT and ST for the main melody and the sub-melody, still more types of scale data can be generated by means of a single storage circuit 5. In that case, it is necessary to provide, in correspondence with the increase in the types of scale data, additional programmable counters having a function similar to those of the programmable counters 6, 6', as well as additional waveform generating sections.

What is claimed is:

1. An electronic tone generator comprising:

a scale-pulse generating section for generating scale-generating pulses;

a scale generating section for generating an output of scale signals in pulse form for respective notes of a melody to be generated, said scale generating section including a storage circuit for storing digital melody data including digital scale data and digital tone length data for the respective notes of the melody at respective addresses thereof, means for addressing said storage circuit to obtain said digital scale data and digital tone length data, and a programmable counter for dividing the scale-generating pulses from said scale-pulse generating section in response the digital scale data obtained from said storage circuit in order to provide said output of scale signals in pulse form for the respective notes of the melody; and a waveform generating section coupled to the output of said scale generating section for generating output waveform signals corresponding to the notes of the melody to be generated, wherein said waveform generating section includes:

(i) a digital waveform generating circuit for receiving said scale signals in pulse form from said scale generating section and generating tone waveform signals in pulse form of corresponding frequencies;

(ii) a digital envelope-data generating circuit responsive to the digital tone length data obtained from said storage circuit of said scale generating section for generating corresponding digital envelope data for the respective notes of the melody, wherein said digital envelope-data generating circuit comprises a source of envelope generating pulses, a dividing circuit receives said envelope generating pulses as an input, said dividing circuit including a plurality of T-type flip flops connected in series having reset terminals connected to receive a digital tone length pulse from said storage circuit of said scale generating circuit as respective reset inputs thereto and output terminals which provide respective pulse outputs for generating the envelope for a note, and a NAND circuit through which said envelope generating pulses are provided for cutting off the input of the envelope generating pulses to said dividing circuit after a predetermined dividing period for the note;

(iii) a digital-to-analog (D/A) converter for converting the digital envelope data from said envelope-data generating circuit into corresponding envelope waveform signal; and (iv) an analog switch using the tone waveform signals in pulse form from said waveform generating circuit for switching the corresponding envelope waveform signals from said D/A converter in order to obtain the output waveform signals for the notes of the melody.

2. An electronic tone generator according to claim 1, wherein said storage circuit stores digital melody data for a plurality of melody parts, said scale generating section has a plurality of programmable counters for generating respective sets of output scale signals for the melody parts, and further comprising a plurality of waveform generating sections coupled respectively to the sets of output scale signals of said scale generating section for generating respective output waveform signals corresponding to the melody parts to be generated.

3. An electronic tone generator according to claim 1, wherein said waveform generating section includes means for mixing said tone waveform signals with waveform signals having frequencies which are integer multiples of the frequencies of said tone waveform signals.

4. An electronic tone generator according to claim 1, wherein said waveform generating section includes means for mixing said tone waveform signals with tremolo waveform signals obtained by executing an AND operation of a switching signal with a tremolo frequency and waveform signals having frequencies which are integer multiples of the frequencies of said tone waveform signals.

5. An electronic tone generator according to claim 1, further comprising a percussion waveform generating section for generating percussion waveform signals for the melody to be generated, a mixing section for mixing and synthesizing the tone waveform signals from said waveform generating section with the percussion waveform signals from said percussion waveform generating section, and an output section for outputting the synthesized waveform signals.

6. An electronic tone generator according to claim 5, wherein said percussion waveform generating section includes a noise generator for generating a percussion noise signal, a percussion envelope-data generating circuit for generating digital percussion envelope data, a digital-to-analog (D/A) converter for converting the digital percussion envelope data from said percussion envelope-data generating circuit into a percussion envelope waveform signal, and an analog switch using the noise signal from said noise generator for switching the percussion envelope waveform signal in order to obtain an output percussion waveform signal giving a sound like that of cymbals.

7. An electronic tone generator according to claim 5, wherein said percussion waveform generating section includes a square-wave generator for generating a square-wave signal having a predetermined frequency, a percussion envelope waveform generating circuit for generating a percussion envelope waveform signal, and an analog switch using the square-wave signal from said square-wave generator for switching the percussion envelope waveform signal in order to obtain an output percussion waveform signal giving a sound like that of a drum.

8. An electronic tone generator according to claim 1, wherein said digital envelope-data generating circuit further comprises a further T-type flip flop having an input terminal connected to receive the envelope generating pulses through an inverter, a reset terminal connected to an output of said dividing circuit indicative of an end of a first predetermined dividing period of said dividing circuit, and an output terminal, and a NOR circuit receiving the output from the output terminal of said further T-type flip flop and the envelope generating pulses provided through said NAND circuit and providing the input to said dividing circuit, wherein said dividing circuit generates envelope waveform data for a second predetermined dividing period having a doubled period following the first predetermined dividing period, such that the resulting envelope waveform signal for the note has a waveform which is approximately equivalent to a CR-discharge characteristic waveform.

* * * * *